US011230412B2

(12) United States Patent
Nilsson et al.

(10) Patent No.: US 11,230,412 B2
(45) Date of Patent: Jan. 25, 2022

(54) PANEL ARRANGEMENT FOR DIVIDING A CONTAINER SPACE

(71) Applicant: Elfa International AB, Västervik (SE)

(72) Inventors: Peter Nilsson, Västervik (SE); Fikret Arnautovic, Västervik (SE)

(73) Assignee: Elfa International AB, Västervik (SE)

( * ) Notice: Subject to any disclaimer, the term of this patent is extended or adjusted under 35 U.S.C. 154(b) by 426 days.

(21) Appl. No.: 16/305,042

(22) PCT Filed: May 17, 2017

(86) PCT No.: PCT/EP2017/061856
§ 371 (c)(1),
(2) Date: Nov. 27, 2018

(87) PCT Pub. No.: WO2017/202666
PCT Pub. Date: Nov. 30, 2017

(65) Prior Publication Data

US 2020/0317403 A1 Oct. 8, 2020

(30) Foreign Application Priority Data

May 27, 2016 (EP) ..... 16171652

(51) Int. Cl.
*B65D 25/04* (2006.01)
*B65D 6/08* (2006.01)

(52) U.S. Cl.
CPC ..... *B65D 25/04* (2013.01); *B65D 7/20* (2013.01)

(58) Field of Classification Search
CPC . B65D 25/04; B65D 7/20; B65D 1/24; B65D 1/36; B65D 5/46064;
(Continued)

(56) References Cited

U.S. PATENT DOCUMENTS 4,102,470 A * 7/1978 Timmons ..... A47B 88/975 220/543
4,420,086 A 12/1983 Bardes
(Continued)

FOREIGN PATENT DOCUMENTS

CA 1248575 A 1/1989
EP 2275281 A2 1/2011
(Continued)

OTHER PUBLICATIONS

International Search Report and Written Opinion received in Patent Cooperation Treaty Application No. PCT/EP2017/061856, dated Aug. 1, 2017, 8 pages.
(Continued)

*Primary Examiner* — Kareen K Thomas
(74) *Attorney, Agent, or Firm* — Hubbard Johnston, PLLC

(57) ABSTRACT

The present disclosure relates to a panel for dividing the interior space of a container. The panel arrangement (1) has a panel (11) provided with an attachment device (17) adapted to affix the panel in relation the container. There is provided at least one opening in the panel, and the attachment device comprises first and second parts (29, 31) located at a respective side of the panel as well as at least one member (39, 41) reaching through the at least one opening (23). A play (49) is provided between the edges of the opening and said at least one member, such that the attachment device can be moved in at least one direction in which the plane of the panel extends.

20 Claims, 3 Drawing Sheets

(58) Field of Classification Search
CPC .. B65D 5/46184; B65D 5/48; B65D 5/48006; B65D 5/48014; B65D 5/48036; B65D 5/48042; B65D 5/48048; B65D 5/50; B65D 7/065; B65D 85/328; A47B 88/975
See application file for complete search history.

(56) References Cited

U.S. PATENT DOCUMENTS 6,164,476 A * 12/2000 Rene ..... B65D 19/12 220/4.31
D689,548 S * 9/2013 Klosky ..... D19/90
8,733,859 B2 * 5/2014 Shewmaker ..... A47L 15/502 312/228.1
9,534,833 B2 * 1/2017 Choi ..... F25D 25/022
10,870,512 B2 * 12/2020 Montanari Ibarra ..... B65D 21/0213
2002/0139809 A1 * 10/2002 Barry ..... A47L 15/502 220/762
2003/0052583 A1 * 3/2003 Son ..... F25D 25/022 312/404
2003/0184199 A1 10/2003 Jananji
2003/0231476 A1 * 12/2003 Vinson ..... G06F 1/185 361/798
2004/0094555 A1 * 5/2004 Raches ..... A47L 15/502 220/476
2004/0155564 A1 * 8/2004 Berger ..... A47B 88/975 312/348.3
2005/0162050 A1 7/2005 Berger et al.
2005/0272330 A1 * 12/2005 Gray ..... B29C 70/78 442/38
2006/0260353 A1 * 11/2006 Uihlein ..... F25D 25/025 62/441
2009/0026906 A1 * 1/2009 Kim ..... F25D 25/025 312/401
2014/0152166 A1 * 6/2014 Baum ..... F25D 25/025 312/404
2015/0069066 A1 * 3/2015 Choi ..... F25D 25/022 220/533
2019/0127113 A1 * 5/2019 Cooper ..... B65D 25/06

FOREIGN PATENT DOCUMENTS

ES 2265203 A1 2/2007
GB 1367781 A 9/1974
JP 2015208368 A 11/2015
RU 79386 U1 1/2009
TW 398484 U 7/2000
TW M330265 U 4/2008
TW M385281 U 8/2010
TW 201138679 A 11/2011
TW 201138680 A 11/2011
TW 201307165 A 2/2013

OTHER PUBLICATIONS

Granting Decision issued in corresponding Russian Application No. 2018143860, dated Sep. 28, 2020.
Office Action issued in corresponding Taiwanese Application No. 106116142, dated Aug. 28, 2020.

* cited by examiner

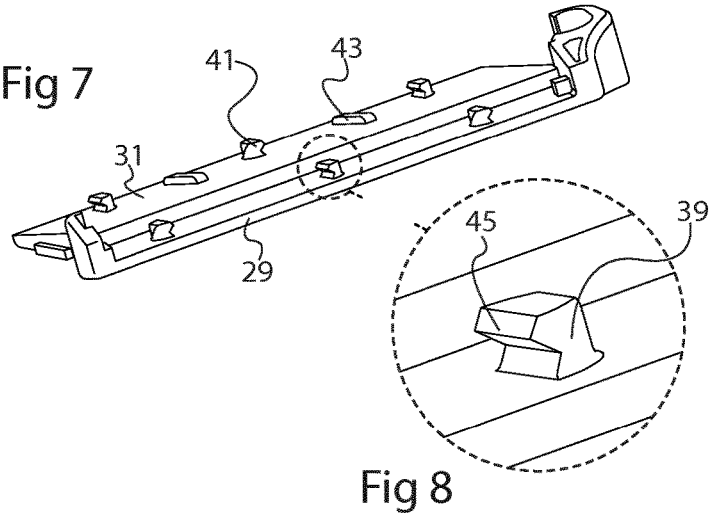
Fig 7
Fig 8
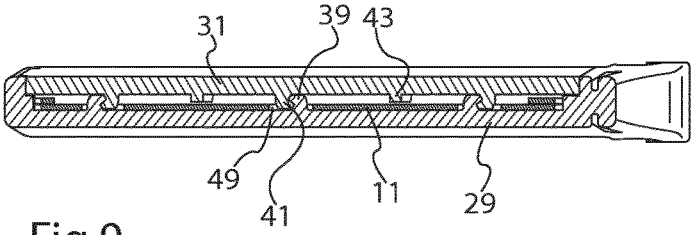
Fig 9
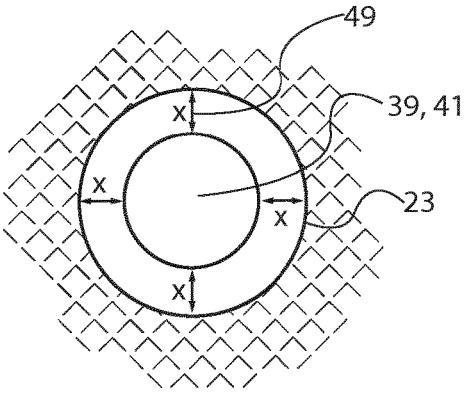
Fig 10
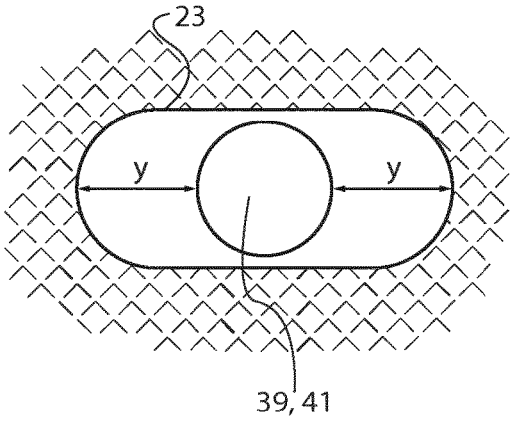
Fig 11

PANEL ARRANGEMENT FOR DIVIDING A CONTAINER SPACE

RELATED APPLICATION

This application, a national phase application of PCT/EP2017/061856, filed May 17, 2017, which claims priority to European Application No. 16171652.7 filed May 27, 2016.

TECHNICAL FIELD

The present disclosure relates to a panel arrangement, for dividing the interior space of a container, wherein a panel is provided with an attachment device adapted to affix the panel in relation to said container.

BACKGROUND

A panel arrangement of the initially mentioned kind is disclosed for instance in US-2005/0162050-A1, where a wire panel is fixed in a wire basket by means of a locking mechanism. A general problem with such arrangements is how to make them inexpensive and easy to use.

SUMMARY

One object of the present disclosure is therefore to provide a panel arrangement that allows and end user to easily and reliably attach the panel to a container, and that can be produced at a relatively low cost. This object is achieved by means of a panel arrangement as defined in claim 1. More specifically in an arrangement of the initially mentioned kind there is provided at least one opening in the panel. The attachment device comprises a first part located at one side of the panel and a second part located on the other side of the panel, at least one of which has a connector for attaching the panel arrangement to said container, and at least one member reaching through the at least one opening. A play is provided between the edges of the opening and said at least one member, such that the attachment device can be moved in at least one direction in which the plane of the panel extends. This allows the attachment device to move a predetermined distance in relation to the panel, such that the panel arrangement as a whole can be adapted to be easily fitted to a container with a relatively large manufacturing tolerance.

The first and second parts may be interconnected, outside the periphery of the panel, by means of a living hinge. This allows the attachment device to be made up of a single component which is devised to clasp an edge of the panel. A snap fit may be provided to keep the first and second parts in a clasping connection with the panel.

The play may allow the member in the opening to move at least 0.6 mm in a direction of the plane of the panel, and even more preferred to move at least 1.5 mm.

The panel arrangement may have two attachment devices, and the play may allow the at least one member to move at least 0.15 percent of the distance between the connectors of the two attachment devices in a direction of the plane of the panel.

The panel may be made in a sheet metal mesh material, and the attachment device may be made in a plastic material that is injection moulded.

BRIEF DESCRIPTION OF THE DRAWINGS

FIG. 7 shows the attachment device of FIG. 5 in a perspective view.

FIG. 8 shows an enlarged portion of FIG. 7.

FIG. 9 illustrates a cross section through an attachment device fitted to a panel.

FIG. 10 illustrates schematically a first example of a pin and opening geometry.

FIG. 11 illustrates schematically a second example of a pin and opening geometry.

DETAILED DESCRIPTION

Figure 1:
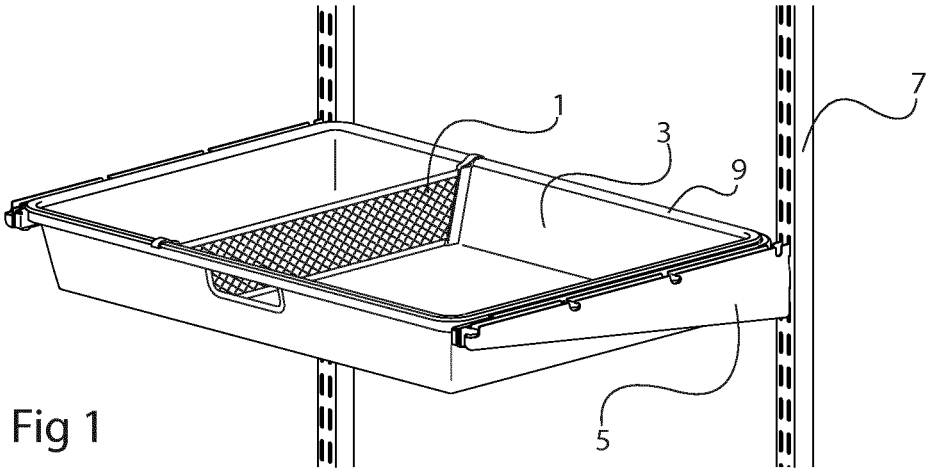
FIG. 1 illustrates one example of use of a panel arrangement in a storage system.

The present disclosure relates to a panel arrangement that may be used for instance to divide the space of a container into different sections. FIG. 1 illustrates a context where the panel arrangement 1 is used. In a storage system, a container 3 is attached to two brackets 5, each of which is in turn suspended from a vertical carrier rail 7, as is well known per se. The panel arrangement 1 is used to divide the inner space of the container 3 into two sections, and the panel arrangement 1 is adapted to be fastened to flanges 9 on the periphery of the container 3, typically with a snap-fit. While this may seem like a simple operation, manufacturing tolerances may be large, for instance if the container 3 is made in a mesh material, and this may render the fitting of the panel arrangement to the container difficult. The present disclosure provides an improved panel arrangement.

Figure 2:
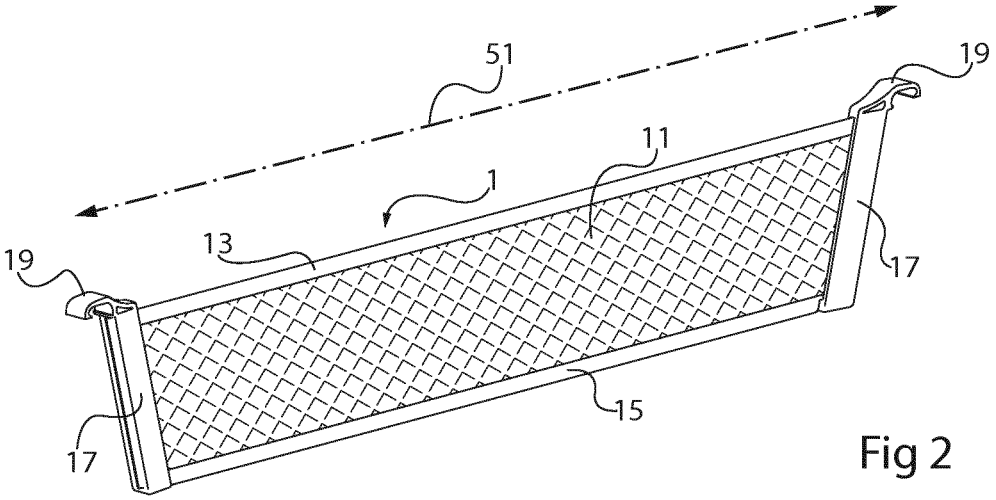
FIG. 2 shows a perspective view of a panel arrangement.

FIG. 2 shows a perspective view of a panel arrangement 1 according to the present disclosure. The arrangement comprises a panel 11 made of a mesh material. By a mesh material is here meant sheet metal that is perforated with a pattern of slits and subsequently expanded across the direction of the slits to provide a structure with a large number of rhombus shaped openings in the panel. In FIG. 2, this structure is indicated with a pattern as it would otherwise appear almost black due to the fine structure. The mesh material is well known per se. The top and bottom edges 13, 15 may comprise unperforated and un-stretched areas which are folded to provide smooth edges. The panel 11 is tapering from the top edge 13 to the bottom edge 15 in order to fit in a container with inclined side walls as illustrated in FIG. 1, although e.g. rectangular panels may be considered as well for other applications. Each side edge of the panel 11 is provided with an attachment device 17, which may comprise a plastic material. The attachment device 17 is attached to the panel 11 in a manner that will be described in detail, and provides a connector in the form of a hook 19 that can be snap-fitted on a flange 9 of the container 3, cf. FIG. 1. It should be noted that other forms of connectors could be provided, for instance a magnetic connector.

Figure 3:
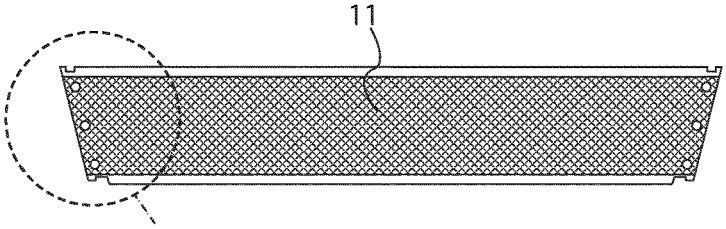
FIG. 3 shows a panel.
Figure 4:
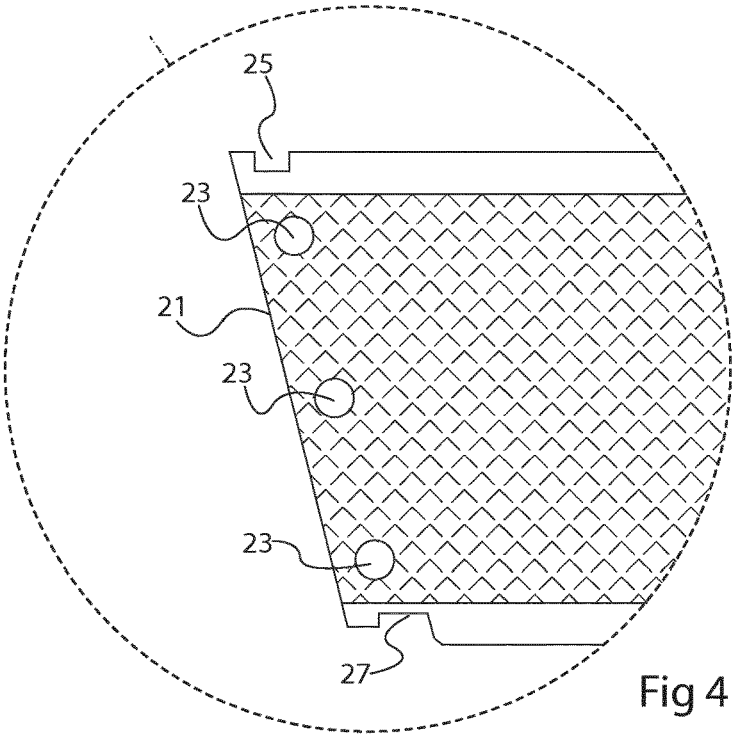
FIG. 4 shows enlarged an end portion of the panel in FIG. 3.

FIG. 3 shows a panel 11 without fitted attachment devices, and FIG. 4 shows enlarged an end portion of the panel 11. The illustrated end portion has a side edge 21 provided with three openings 23, and a top edge notch 25 and a bottom edge notch 27. The openings and notches may be punched out from the panel. It should be noted that different configurations e.g. with fewer or more openings and notches can be considered.

Figure 5:
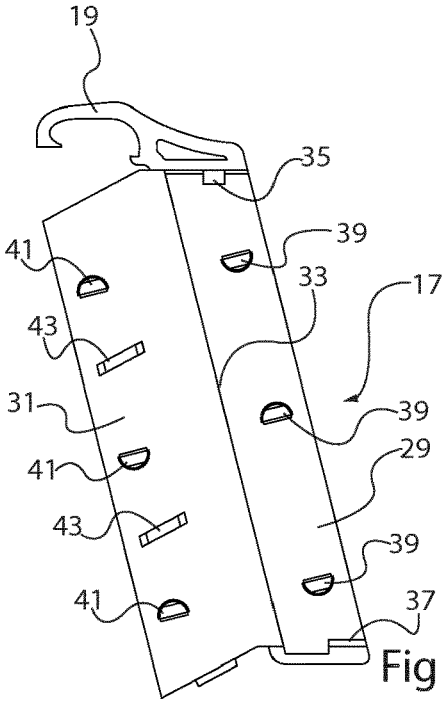
FIG. 5 shows an attachment device in an open state.

FIG. 5 shows an attachment device 17 in an open state. The attachment device 17 can be produced in one piece in plastic by injection moulding. Suitable materials include polyamide, PA, polypropylene, PP, and polyethylene, PE, for instance.

In the illustrated case, the attachment device 17 includes a first part 29 and a second part 31 which are connected by a living hinge 33, i.e. a thin flexible portion. The attachment device 17 can thereby be formed in one piece, even though an attachment device made up of two or more pieces is conceivable in the present disclosure. The two parts 29, 31 can be folded at the living hinge 33, and be snapped together over the side edge 21 of the panel, cf. FIG. 4. The attachment device 17 has a number of features adapted to connect with such a side edge.

To start with, the first part 29 comprises upper 35 and lower 37 projections adapted to fit in the upper 25 and lower 27 notch of the panel, and with a significant play as will be disclosed. The first part 29 further comprises pin portions 39 rising from a flat surface thereof and being configured to fit in the openings 23 of the panel with a significant play as well.

The second part 31 comprises pin portions 41 rising from its surface as well, and further ribs 43 are provided rising from the surface of the second part 31.

Figure 6:
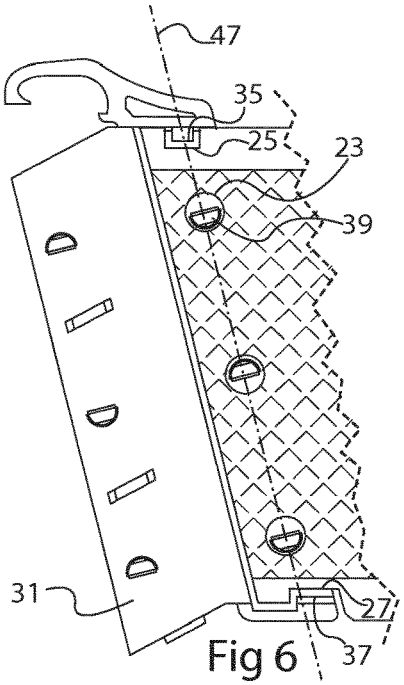
FIG. 6 illustrates the open attachment device when being fitted to a panel.

FIG. 6 illustrates the open attachment device 17 when being fitted to a panel 11. As illustrated, the pin portions 39 of the first attachment device part 29 fit in the openings 23 of the panel 11, and the upper and lower projections 35, 37 fit in the upper and lower notches 25, 27 of the panel 11. The second part 31 of the attachment device is then folded, at the living hinge 33, over the panel 11. There is provided a snap-fit that affixes the attachment device 17 on the panel 11 in this way, as will now be described.

FIG. 7 shows the attachment device of FIG. 5 in a perspective view, and FIG. 8 shows an enlarged portion of FIG. 7. As shown, the pin portion 39 of the first attachment device part 29 comprises a shoulder 45 that functions as a hook, interacting with a similar shoulder on an opposing pin portion 41 on the second part 31. Each pin portion 39, 41 may thus be formed as a half cylinder which when snapped together form a full cylinder that extends through the opening 23. This is further shown in FIG. 9 illustrating a cross section corresponding to a line 47 in FIG. 6 when the attachment device 17 has been fitted to the panel 11. As shown, the opposing pin portions 39, 41 have snapped together to provide a firm grip through the opening in the panel 11. The ribs 43 extending from the second attachment device part 31 keeps the panel 11 in place within the space between the first and second parts such that it cannot move substantially therein in a direction perpendicular to the plane of the panel.

However, the attachment device 17 is arranged to allow some movement in relation to the panel 11. This is done to allow the panel arrangement to take up some tolerances, particularly allowing a panel arrangement to be reliably and easily connected to a container even if e.g. the distance between to flanges of opposing container walls can vary to some extent. This adaptability of the panel arrangement is achieved by providing a play between the edges of an opening and a member protruding through an opening, such that the attachment device can be moved in at least one direction in which the plane of the panel extends. Thus a play is provided in between the cylinder formed by the pins 39, 41 and the openings 23, and between the notches 25, 27 and the projections 35, 37, respectively, if provided. The configuration of notches 25, 27 and openings 23 of the panel may match the configuration of pins 39, 41 and projections 35, 37 in the attachment device 17 such that the protruding members, projections and cylinder formed by pins, are centred in the respective openings to allow a uniform movement of the attachment device as a whole.

FIG. 10 illustrates schematically a first example of a pin and opening geometry. In the present disclosure, there is provided a play 49 between the edges of the opening 23 and the protruding pins 39, 41. Thereby, the attachment device as a whole can be moved in a direction in which the plane of the panel extends. In the illustrated case, the diameter of the cylindrical shape made up by the pins 39, 41 is about 2.5 mm while the diameter of the circular opening is about 4.0 mm. This allows the pin to be moved x=0.75 mm in any given direction or a total movement of 1.5 mm.

FIG. 11 illustrates schematically a second example of a pin and opening geometry. In this case, the opening is oval, while the shape made up by the pins still is cylindrical. This means that a much greater movement $2y$ is allowed in one direction in the plane in which the panel extends is allowed as compared to another direction in which the plane extends. This means that the capability of the attachment device to be moved can be fine-tuned depending on the application in which the panel arrangement is used. It is also possible to allow different amounts of movement at different pins. This means that rather than allowing the attachment device to be shifted in different directions, it is possible to let the attachment device pivot to some extent around a pivot point where a comparatively small movement is allowed.

Again with reference to FIG. 10, the amount of play needed depends on the tolerances of the panel arrangement itself and on the tolerances of the container or the like that the panel arrangement is to be attached to. In general, a total amount of movement may exceed 0.6 mm (x=0.3 mm). In most cases, the amount of allowed movement should be decided by the distance that the panel arrangement is intended to cover. A longer panel arrangement will most likely need to compensate for greater tolerances than does a shorter one. To provide a sufficient capability to take up tolerances, a total movement ($2x$) of at least 0.15 percent of the width 51 between opposing connectors 19 (cf. FIG. 2) of the opening in a direction may be suitable.

The present disclosure is not restricted to the examples given above, and may be varied and altered in different ways within the scope of the appended claims. For instance, while the description shows a panel made of a mesh material, panel may as well be made in un-stretched sheet metal, a plastic material, or even cardboard, etc.

Although the example shown illustrate opposing pins extending from both sides of the panel and interlocking half-way between the first and second parts of the attachment device, it is possible to allow a single pin extend through an opening from either of the first and second part and connecting with the other of the first and second parts. A locking arrangement may be provided elsewhere on the attachment device.

Instead of or in combination with the described snap function closing the attachment device to clasp the panel, it would be possible to permanently attach e.g. a plastic material to the panel by for instance melting a pin extending through an opening in the panel to an attachment device on the other side of the opening similar to spot welding.

The invention claimed is:

1. A panel arrangement for dividing the interior space of a container wherein a panel with opposite ends, each of the ends having a side edge, is provided with a fastener adapted to affix each of the opposite ends the end of the panel in relation to said container, wherein:

the panel comprises at least one opening in the panel near one of its side edges; and the fastener affixing the end of the panel with the side edge near at least one opening to the container comprises:

a first part located at one side of the panel and a second part located on the other side of the panel, at least one of which has a connector for attaching the panel arrangement to said container; and at least one member reaching through the at least one opening;

wherein a play is provided between the edges of the opening and said at least one member, such that the fastener can be moved in relation to the panel in at least one direction in which the plane of the panel extends.

2. Panel arrangement according to claim 1, wherein the first and second parts are interconnected, outside the periphery of the panel, by a living hinge.

3. Panel arrangement according to claim 2, wherein a snap fit is provided to keep the first and second parts in a clasping connection with the panel.

4. Panel arrangement according to claim 1, wherein the play allows the at least one member to move at least 0.6 mm in a direction of the plane of the panel.

5. Panel arrangement according to claim 4, wherein the play allows the at least one member to move at least 1.5 mm in a direction of the plane of the panel.

6. Panel arrangement according to claim 4, wherein the play allows the at least one member to move at least 0.15 percent of the distance between the connectors of the two fasteners in a direction of the plane of the panel.

7. Panel arrangement according to claim 1, wherein the panel is made in a sheet metal mesh material.

8. Panel arrangement according to claim 1, wherein the fastener is made in a plastic material that is injection molded.

9. Panel arrangement according to claim 2, wherein the play allows the at least one member to move at least 0.6 mm in a direction of the plane of the panel.

10. Panel arrangement according to claim 3, wherein the play allows the at least one member to move at least 0.6 mm in a direction of the plane of the panel.

11. Panel arrangement according to claim 2, wherein the panel is made in a sheet metal mesh material.

12. Panel arrangement according to claim 3, wherein the panel is made in a sheet metal mesh material.

13. Panel arrangement according to claim 4, wherein the panel is made in a sheet metal mesh material.

14. Panel arrangement according to claim 5, wherein the panel is made in a sheet metal mesh material.

15. Panel arrangement according to claim 6, wherein the panel is made in a sheet metal mesh material.

16. Panel arrangement according to claim 2, wherein the fastener is made in a plastic material that is injection molded.

17. Panel arrangement according to claim 3, wherein the fastener is made in a plastic material that is injection molded.

18. Panel arrangement according to claim 4, wherein the fastener is made in a plastic material that is injection molded.

19. Panel arrangement according to claim 5, wherein the fastener is made in a plastic material that is injection molded.

20. Panel arrangement according to claim 7, wherein the fastener is made in a plastic material that is injection molded.

* * * * *